US005916862A

United States Patent [19]

Morelli et al.

[11] Patent Number: 5,916,862

[45] Date of Patent: Jun. 29, 1999

[54] DETERGENT COMPOSITIONS CONTAINING AMINES AND ANIONIC SURFACTANTS

[75] Inventors: Joseph Paul Morelli, Cincinnati, Ohio; Dimitris Lappas, Brussels, Belgium; Sherri Lynn Randall, Fairfield; Rajan Keshev Panandiker, Cincinnati, both of Ohio; Jean-Pol Boutique, Ernage, Belgium; Chris Efstathios Housmekerides, Brussels, Belgium

[73] Assignee: The Procter & Gamble Company, Cincinnati, Ohio

[21] Appl. No.: 08/981,371

[22] PCT Filed: Jun. 20, 1995

[86] PCT No.: PCT/US95/07824

§ 371 Date: Dec. 22, 1997

§ 102(e) Date: Dec. 22, 1997

[87] PCT Pub. No.: WO97/00929

PCT Pub. Date: Jan. 9, 1997

[51] Int. Cl.[6] ..... C11D 1/04; C11D 1/29; C11D 3/30

[52] U.S. Cl. ..... 510/321; 510/283; 510/337; 510/338; 510/341; 510/350; 510/351; 510/356; 510/357; 510/499

[58] Field of Search ..... 510/283, 321, 510/337, 338, 341, 350, 351, 356, 357, 499

[56] References Cited

FOREIGN PATENT DOCUMENTS

| | | |
|---|---|---|
| 276643 (ABS) | 7/1992 | Czechoslovakia . |
| 105471 | 4/1984 | European Pat. Off. . |
| 512533 | 11/1992 | European Pat. Off. . |
| 97/06235 | 2/1997 | WIPO . |

*Primary Examiner*—Mark Kopec
*Assistant Examiner*—Gregory R. Delcotto
*Attorney, Agent, or Firm*—Jacobus C. Rasser; Kim W. Zerby; D. Mitchell Goodrich

[57] ABSTRACT

A liquid detergent composition comprising anionic surfactants selected from the group of alkyl alkoxy sulfates and alkyl sulfates, characterized in that said detergent composition further comprises a tertiary amine having formula (1), wherein $R_1$ is $C_4$–$C_{10}$, preferably $C_8$–$C_{10}$ alkyl; n is 2–4, preferably n is 3; $R_2$ is $C_1$–$C_4$ or formula (2), whereby x is 1–5, $R_3$ is H or $C_1$–$C_2$ alkyl.

(1)

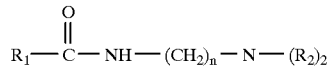

(2)

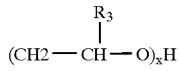

15 Claims, No Drawings

DETERGENT COMPOSITIONS CONTAINING AMINES AND ANIONIC SURFACTANTS

FIELD OF THE INVENTION

The present invention relates to detergent compositions containing surfactants selected from amines. More particularly, the invention is directed to detergent compositions containing anionic surfactants selected from the group consisting of alkyl alkoxylated sulfates and alkyl sulfates, said composition further containing specific tertiary amines.

BACKGROUND OF THE INVENTION

Detergent compositions useful for cleaning purposes, such as laundering of fabrics, have commonly utilized a variety of surfactants.

The ability of surfactants to clean a large variety of soils and stains from fabrics present in the typical load of laundry is of high importance in the evaluation of detergent performance. Unfortunately, the relative ability of each surfactant to meet various performance criteria is among others depending on the presence of cosurfactants.

The recent trend towards partial or total replacement of Linear alkyl benzene sulfonate surfactants (LAS) has urged the detergent formulators to rebalance their formulations with different surfactants. For example, quaternary ammonium salts are less efficient in boosting the greasy cleaning performance in Nil-LAS formulations.

There is thus a standing desire for performance and flexibility reasons to make available a surfactant system capable of providing optimum detergency performance which is equivalent to that of LAS-containing detergents.

The above objective has been met by a surfactant system comprising anionic surfactants selected from the group consisting of alkyl alkoxylated sulfates and alkyl sulfates, said surfactant system further comprising a cosurfactant selected from the group of tertiary amines.

It has been surprisingly found that detergent compositions containing said surfactant system exhibit detergency performance equivalent to that of LAS-containing detergents.

In addition, it has been found that a small amount of certain tertiary amines according to the present invention constitutes an efficient and compatible sud suppressing system. This additional benefit allows to use the amines in a dual function, e.g. surfactant and suds suppressor, thereby facilitating the formulation of concentrated liquid detergents.

Liquid detergent compositions formulated with said surfactant system are extremely useful when the liquid detergent compositions are in direct contact with the fabrics such as during pretreatment.

The amines according to the present invention are particulary suitable because of their acceptable environmental profile and good odor characteristics.

Amines have been described in the art in liquid detergent compositions. EP 160 762, EP 137 615 and EP 137 616 disclose liquid detergents which comprise cyclohexylamine. EP 177 165 discloses detergent compositions which comprise anionics, cellulose and a variety of tertiary amines. EP 11 340 discloses softening through the wash detergent compositions which comprise tertiary amines and clay. DE 32 07 487, GB 2 094 826, GB 2 095 275 and EP 137 397 disclose compositions which comprise anionics and quaternary ammonium compounds. EP 120 528 discloses compositions comprising anionics, as well as tertiary amines. EP 26 528 and EP 26 529 disclose compositions comprising anionics and quaternary ammonium compounds.

SUMMARY OF THE INVENTION

The detergent compositions according to the present invention comprise anionic surfactants selected from the group of alkyl alkoxy sulfates and alkyl sulfates, characterized in that said detergent composition further comprises specific tertiary amines.

The detergent compositions preferably comprise at least 5%, more preferably from 10% to 65% and most preferably from 15% to 40% by weight of the surfactant system as described hereinabove.

Preferably, the weight ratio of the amine cosurfactant to the alkyl alkoxylated sulfates and alkyl sulfates is from 1:1 to 1:250, more preferably from 1:5 to 1:100 and most preferably from 1:10 to 1:40.

DETAILED DESCRIPTION OF THE INVENTION

The detergent compositions according to the present invention comprise anionic surfactants selected from the group of alkylalkoxy sulfates and alkyl sulfates.

Alkyl Alkoxylated Sulfates and/or Alkyl Sulfates

The alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include ethanol-, triethanol-, methyl-, dimethyl, trimethyl-ammonium cations and quaternary ammonium cations such as tetramethyl-ammonium and dimethyl piperidinium cations and those derived from alkylamines such as ethylamine, diethylamine, triethylamine, mixtures thereof, and the like. Exemplary surfactants are $C_{12}$–$C_{15}$ alkyl polyethoxylate (1.0) sulfate ($C_{12}$–$C_{15}$E(1.0)M), $C_{12}$–$C_{15}$ alkyl polyethoxylate (2.25) sulfate ($C_{12}$–$C_{15}$E(2.25)M), $C_{12}$–$C_{15}$ alkyl polyethoxylate (3.0) sulfate ($C_{12}$–$C_{15}$E(3.0)M), and $C_{12}$–$C_{15}$ alkyl polyethoxylate (4.0) sulfate ($C_{12}$–$C_{15}$E(4.0)M), wherein M is conveniently selected from sodium and potassium.

The alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperidinium cations and quaternary ammonium cations derived from alkylamines such as ethylamine, diethylamine, triethylamine, and mixtures thereof, and the like).

The Amine

The amines as used herein refer to tertiary amines which are believed to form a mixed micelle with the anionic surfactant. The tertiary amines according to the present invention have the formula

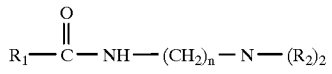

wherein $R_1$ is $C_4$–$C_{10}$, preferably $C_8$–$C_{10}$ alkyl; n is 2–4, preferably n is 3; $R_2$ is $C_1$–$C_4$ or

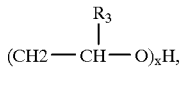

whereby x is 1–5, $R_3$ is H or $C_1$–$C_2$ alkyl.

The tertiary amines according to the present invention can be made by conventional processing such as condensation processes:

$$RCOOH+H_2N(CH_2)_3NMe_2 \rightarrow RCONH(CH_2)_3NMe_2+H_2O$$

While not intending to be limited by theory, it is believed that the amine cosurfactant and anionic surfactant herein form complexes which enhance packing of the surfactants at the oil/water interface, thereby lowering interfacial tension and improving detergency. The amine surfactants would be at least partially protonated in the product and during the wash thus can form positively charged species capable of complexing with the anionic surfactant.

Another aspect of the invention relates to the surprising finding that low amounts of certain tertiary amines of the present invention provide suds control to the detergent compositions formulated therewith. The amounts in which the amines are used for controlling the suds are from 0.1 to 10%, preferably from 0.1 to 5%, most preferably from 0.5 to 4% by weight of the detergent composition.

Detergent Ingredients

In another embodiment of the present invention, a liquid detergent composition is provided comprising the surfactant system of the present invention mixed with detergent ingredients. A wide range of surfactants can be used in the detergent composition of the present invention. The detergent compositions according to the present invention will preferably comprise a surfactant system which is substantially free of linear alkylbenzene sulfonate surfactant.

A typical listing of anionic, nonionic, ampholytic and zwitterionic classes, and species of these surfactants, is given in U.S. Pat. No. 3,664,961 issued to Norris on May 23, 1972.

Other suitable anionic surfactants that can be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

$$R^3—CH(SO_3M)—C(O)—OR^4$$

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleoyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$-M+ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the laundry detergent compositions of the present invention typically comprise from about 1% to about 40%, preferably from about 5% to about 25% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Very suitable as nonionic surfactants are poly hydroxy fatty acid amide surfactants of the formula $$R^2—C(O)—N(R^1)—Z,$$

wherein $R^1$ is H, or $R^1$ is $C_{14}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Highly preferred nonionics are amine oxide surfactants. The compositions of the present invention may comprise amine oxide in accordance with the general formula I:

$$R^1(EO)_x(PO)_y(BO)_zN(O)(CH_2R')_2.qH_2O \quad (I)$$

In general, it can be seen 1that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R_1=C_8$–$C_{18}$, R' =H and q=0–2, preferably 2. These amine oxides are illustrated by C12–14 alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18, ADMOX 12 and especially ADMOX 14 from Ethyl Corp.

Preferred embodiments include hexadecyldimethylamine oxide dihydrate, dodecyldimethylamine oxide dihydrate, octadecyldimethylamine oxide dihydrate, hexadecyltris (ethyleneoxy)dimethyl-amine oxide, and tetradecyldimethylamine oxide dihydrate.

Whereas in certain of the preferred embodiments R'=H, there is some latitude with respect to having R' slightly larger than H. Specifically, the invention further encompasses embodiments wherein R'=$CH_2OH$, such as hexadecylbis(2-hydroxyethyl)amine oxide, tallowbis(2-hydroxyethyl)amine oxide, stearylbis(2-hydroxyethyl) amine oxide and oleylbis(2-hydroxyethyl)amine oxide, dodecyldimethylamine oxide dihydrate.

When included therein, the laundry detergent compositions of the present invention typically comprise nonionic surfactants in the weight ratio of anionic surfactant to nonionic surfactant from 6:1 to 1:3, preferably from 5:1 to 2:1.

Cationic detersive surfactants suitable for use in the laundry detergent compositions of the present invention are those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N+X—$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Preferred cationic surfactants are the water-soluble quaternary ammonium compounds useful in the present composition having the formula:

$$R_1R_2R_3R_4N^+X^- \quad (i)$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and —$(C_2H_4O)_xH$ where x has a value from 1 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quaternary ammonium compounds of formulae (i) for use herein are:

- coconut trimethyl ammonium chloride or bromide;
- coconut methyl dihydroxyethyl ammonium chloride or bromide;
- decyl triethyl ammonium chloride;
- decyl dimethyl hydroxyethyl ammonium chloride or bromide;
- $C_{12-15}$ dimethyl hydroxyethyl ammonium chloride or bromide;
- coconut dimethyl hydroxyethyl ammonium chloride or bromide;

myristyl trimethyl ammonium methyl sulphate;

lauryl dimethyl benzyl ammonium chloride or bromide;

lauryl dimethyl (ethenoxy)$_4$ ammonium chloride or bromide;

choline esters (compounds of formula (i) wherein $R_1$ is —$CH_2$—O—C(O)—$C_{12-14}$ alkyl and $R_2R_3R_4$ are methyl).

Other cationic surfactants useful herein are also described in U.S. Pat. 4,228,044, Cambre, issued Oct. 14, 1980.

When included therein, the laundry detergent compositions of the present invention typically comprise from 0.5% to about 5%, preferably from about 1% to about 3% by weight of such cationic surfactants.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate , myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071. Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

Detergency builder salts are normally included in amounts of from 3% to 50% by weight of the composition preferably from 5% to 30% and most usually from 5% to 25% by weight.

Optional Detergent Ingredients

Preferred detergent compositions of the present invention may further comprise one or more enzymes which provide cleaning performance and/or fabric care benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof.

A preferred combination is a detergent composition having a cocktail of conventional applicable enzymes like protease, amylase, lipase, cutinase and/or cellulase in conjunction with the lipolytic enzyme variant D96L at a level of from 50 LU to 8500 LU per liter wash solution.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2,075,028; GB-A-2,095,275 and DE-OS-2,247,832.

Examples of such cellulases are cellulases produced by a strain of Humicola insolens (*Humicola grisea* var. *thermoidea*), particularly the Humicola strain DSM 1800. Other suitable cellulases are cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Preferred commercially available protease enzymes include those sold under the tradenames Alcalase, Savinase, Primase, Durazym, and Esperase by Novo Nordisk A/S (Denmark), those sold under the tradename Maxatase, Maxacal and Maxapem by Gist-Brocades, those sold by Genencor International, and those sold under the tradename Opticlean and Optimase by Solvay Enzymes. Also proteases described in our co-pending application U.S. Ser. No. 08/136,797 can be included in the detergent composition of the invention. Protease enzyme may be incorporated into the compositions in accordance with the invention at a level of from 0.0001% to 2% active enzyme by weight of the composition.

A preferred protease herein referred to as "Protease D" is a carbonyl hydrolase variant having an amino acid sequence not found in nature, which is derived from a precursor carbonyl hydrolase by substituting a different amino acid for the amino acid residue at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the concurrently filed patent application of A. Baeck et al. entitled "Protease-Containing Cleaning Compositions" having U.S. Ser. No. 08/322,676, filed Oct. 13, 1994, which is incorporated herein by reference in its entirety.

Highly preferred enzymes that can be included in the detergent compositions of the present invention include lipases. It has been found that the cleaning performance on greasy soils is synergistically improved by using lipases. Suitable lipase enzymes include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereinafter referred to as "Amano-P". Further suitable lipases are lipases such as M1 Lipase® and Lipomax® (Gist-Brocades). Highly preferred lipases are the D96L lipolytic enzyme variant of the native lipase derived from *Humicola lanuginosa* as described in U.S. Ser. No. 08/341,826. Preferably the *Humicola lanuginosa* strain DSM 4106 is used. This enzyme is incorporated into the composition in accordance with the invention at a level of from 50 LU to 8500 LU per liter wash solution. Preferably the variant D96L is present at a level of from 100 LU to 7500 LU per liter of wash solution. More preferably at a level of from 150 LU to 5000 LU per liter of wash solution.

By D96L lipolytic enzyme variant is meant the lipase variant as described in patent application WO 92/05249 viz. wherein the native lipase ex *Humicola lanuginosa* aspartic acid (D) residue at position 96 is changed to Leucine (L). According to this nomenclature said substitution of aspartic acid to Leucine in position 96 is shown as: D96L.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

The lipases and/or cutinases are normally incorporated in the detergent composition at levels from 0.0001% to 2% of active enzyme by weight of the detergent composition.

Amylases (& and/or β) can be included for removal of carbohydrate-based stains. Suitable amylases are Termamyl® (Novo Nordisk), Fungamyl® and BAN® (Novo Nordisk).

The above-mentioned enzymes may be of any suitable origin, such as vegetable, animal, bacterial, fungal and yeast origin.

Said enzymes are normally incorporated in the detergent composition at levels from 0.0001% to 2% of active enzyme by weight of the detergent composition. Other suitable detergent ingredients that can be added are enzyme oxidation scavengers which are described in Copending European Patent application 92870018.6 filed on Jan. 31, 1992. Examples of such enzyme oxidation scavengers are ethoxylated tetraethylene polyamines.

Other components used in detergent compositions may be employed, such as soil-suspending agents, soil-release polymers, abrasives, bactericides, tarnish inhibitors, coloring agents, foam control agents, corrosion inhibitors and perfumes.

Preferably, the liquid compositions according to the present invention are in "concentrated form"; in such case, the liquid detergent compositions according to the present invention will contain a lower amount of water, compared to conventional liquid detergents. The level of water is less than 50%, preferably less than 30% by weight of the detergent compositons.

Said concentrated products provide advantages to the consumer, who has a product which can be used in lower amounts and to the producer, who has lower shipping costs.

The liquid compositions are especially effective when applied directly to soils and stains in a pretreatment step.

The detergent compositions of the present invention can also be used as detergent additive products. Such additive products are intended to supplement or boost the performance of conventional detergent compositions.

The detergent compositions according to the present invention include compositions which are to be used for cleaning of substrates, such as fabrics, fibers, hard surfaces, skin etc., for example hard surface cleaning compositions (with or without abrasives), laundry detergent compositions, automatic and non-automatic dishwashing compositions.

The following examples are meant to exemplify compositions of the present inventions, but are not necessarily meant to limit the scope of the invention.

EXAMPLE I

The following liquid detergent compositions are made:

| | % by weight of the detergent compositions | | | | |
|---|---|---|---|---|---|
| | A | B | C | D | E |
| Lineair alkylbenzene sulfonate | 18 | — | — | — | — |
| $C_{12}$–$C_{15}$ Alkyl ethoxylated sulfate | — | 2 | 8 | 11 | 5 |
| $C_8$–$C_{10}$ propyl dimethyl amine | 2 | 2 | 2 | 2 | 1 |
| $C_{12}$–$C_{14}$ alkyldimethyl amine oxide | — | — | — | — | 2 |
| $C_{12}$–$C_{15}$ Alkyl sulfate | — | 17 | 12 | 7 | 8 |
| $C_{12}$–$C_{14}$ N-methyl glucamide | — | 5 | 4 | 4 | 3 |
| $C_{12}$–$C_{14}$ fatty alcohol ethoxylate | 12 | 6 | 1 | 1 | 1 |
| $C_{12}$–$C_{18}$ Fatty acid | 11 | 11 | 4 | 4 | 3 |
| Citric acid anhydrous | 5 | 1 | 3 | 3 | 2 |
| Diethylene triamine penta methylene phosphonic acid | 1 | 1 | 1 | 1 | 0.5 |
| Monoethanolamine | 11 | 8 | 5 | 5 | 2 |
| Sodium hydroxide | 1 | 1 | 2.5 | 1 | 1.5 |
| Propanediol | 12.7 | 14.5 | 13.1 | 10.0 | 8 |
| Ethanol | 1.8 | 1.8 | 4.7 | 5.4 | 1 |
| Amylase (300 KNU/g) | 0.1 | 0.1 | 0.1 | 0.1 | 0.1 |
| Lipase D96/L (100 KNU/g) | 0.15 | 0.15 | 0.15 | 0.15 | 0.15 |
| Protease (34 g/l) | 0.5 | 0.5 | 0.5 | 0.5 | 0.5 |
| Endo-A (5000 CEVU/g) | 0.05 | 0.05 | 0.05 | 0.05 | 0.5 |
| Carezyme (5000 CEVU/g) | 0.09 | 0.09 | 0.09 | 0.09 | 0.9 |
| Terephthalate-based polymer | 0.5 | 0.5 | — | 0.3 | 0.3 |
| Boric acid | 2.4 | 2.4 | 2.8 | 2.8 | 2.4 |
| Sodium xylene sulfonate | — | — | 3 | — | — |
| DC 3225C | 1 | 1 | 1 | 1 | 1 |
| 2-butyl-octanol | 0.03 | 0.04 | 0.04 | 0.03 | 0.03 |
| Branched silicone | 0.3 | 0.3 | 0.3 | 0.3 | 0.3 |
| Water & Minors | | | up to 100% | | |

The above liquid detergent compositions (A–E) are found to be very efficient in the removal of greasy/oily soils under various usage conditions while having a controlled suds profile. The same results were obtained when $C_8$–$C_{10}$ amidopropyldimethylamine was replaced in Compositions (A–E) by $C_8$-amidopropyldimethylamine and $C_{10}$ amido propylamine dimethylamine.

What is claimed is:

1. A liquid detergent composition, comprising: propanediol, enzymes, anionic surfactants selected from the group consisting of alkyl alkoxy sulfates and alkyl sulfates, said detergent composition further comprising a tertiary amine having a formula:

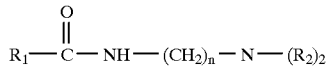

wherein $R_1$ is $C_4$–$C_{10}$ alkyl; n is 2–4; $R_2$ is $C_1$–$C_4$ or

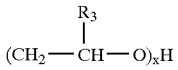

whereby x is 1–5, $R_3$ is H or $C_1$–$C_2$ alkyl; and wherein the weight ratio of propanediol to enzymes is from about 3.7:1 to about 16:1.

2. A liquid detergent composition according to claim 1 having a tertiary formula as defined in claim 1 wherein $R_1$ is a $C_8$–$C_{10}$ alkyl and n is 3.

3. A liquid detergent composition according to claim I wherein the weight ratio of the tertiary amine to the anionic surfactants is from 1:1 to 1:250.

4. A liquid detergent composition according to claim 3 wherein the anionic surfactants are selected from the group consisting of alkyl ethoxylated sulfate and $C_{12}$–$C_{15}$ alkyl sulfate.

5. A liquid detergent composition according to claim 1 further comprising a nonionic surfactant selected from the group consisting of polyhydroxy fatty acid amides and/or amine oxides.

6. A liquid detergent composition according to claim 5 wherein said amine oxide is $C_{12}$–$C_{14}$ alkyl dimethyl amine oxide.

7. A liquid detergent composition according to claim 1 further comprising other surfactants, builders and other conventional detergent ingredients.

8. A liquid detergent composition according to claim 1 which is free of linear alkylbenzene sulfonate surfactant.

9. A liquid detergent composition according to claim 1 wherein $R_1$ is $C_8$–$C_{10}$ alkyl.

10. A liquid detergent composition according to claim 1 wherein n is 3.

11. A liquid detergent composition according to claim 11 wherein n is 3.

12. A liquid detergent composition according to claim 3 wherein the weight ratio of the tertiary amine to the alkyl anionic surfactants is from 1:5 to 1:100.

13. A liquid detergent composition according to claim 12 wherein the weight ratio of the tertiary amine to the alkyl anionic surfactants is from 1:10 to 1:40.

14. A process comprising the steps of:

(i) preparing a liquid detergent composition comprising: propanediol, enzymes, anionic surfactants selected from the group consisting of alkyl alkoxy sulfates and alkyl sulfates, said detergent composition further comprising a tertiary amine having a formula:

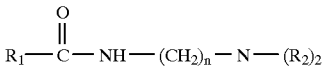

wherein $R_1$ is $C_4$–$C_{10}$ alkyl; n is 2–4; $R_2$is $C_1$–$C_4$ or

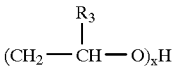

whereby x is 1–5, $R_3$ is H or $C_1$–$C_2$ alkyl; and wherein the weight ratio of propanediol to enzymes is from about 3.7:1 to about 16:1;

(ii) applying the liquid detergent composition directly to a stain covering a localized area of a fabric;

(iii) placing the fabric together with an amount of the liquid detergent composition inside a washing machine; and (iv) operating the washing machine as prescribed by the manufacturer.

15. A liquid detergent composition according to claim 1 wherein the weight ratio of propanediol to enzymes is from about 11:1 to about 16:1.

* * * * *